United States Patent [19]

Bernstein et al.

[11] 4,353,071

[45] Oct. 5, 1982

[54] SELF-ERECTING FLOATABLE STRUCTURE

[75] Inventors: Robert G. Bernstein; David A. Clunies, both of Gaithersburg, Md.

[73] Assignee: Fairchild Industries, Inc., Germantown, Md.

[21] Appl. No.: 258,407

[22] Filed: Apr. 28, 1981

[51] Int. Cl.[3] ..... H01Q 1/34

[52] U.S. Cl. ..... 343/709; 343/720

[58] Field of Search ..... 343/709, 710, 720

[56] References Cited

U.S. PATENT DOCUMENTS

| | | | |
|---|---|---|---|
| 2,907,875 | 10/1959 | Seyfang | 343/709 |
| 3,068,477 | 12/1962 | Tennyson | 343/709 |
| 3,095,568 | 6/1963 | Aine et al. | 343/709 |
| 3,312,902 | 4/1967 | Dean et al. | 343/709 |
| 4,053,896 | 10/1977 | Bitter, Jr. | 343/709 |
| 4,110,724 | 8/1978 | Peters | 343/709 |

*Primary Examiner*—David K. Moore

*Attorney, Agent, or Firm*—Michael W. York

[57] ABSTRACT

A self-erecting floatable structure which includes a collapsible extendible element and a hollow substantially cylindrical shaped core member about which the collapsible extendible element can be wound and an inflatable torus that is connected to the collapsible extendible element. The hollow cylindrical shaped core member is configured so as to readily receive the collapsed torus and two gas generating members are connected to the torus which generates gas to inflate the torus when they come into contact with water. Provisions are made for maintaining the torus and the collapsible extendible element in a compact configuration with the cylindrical shaped core member until the self-erecting floatable structure comes into contact with water. Upon contact with water the self-erecting floatable structure erects itself in the water so that the inflated torus and the core member which acts as a weight maintain the upper portion of the extendible element in a substantially upright position.

8 Claims, 13 Drawing Figures

C
92
30
A
COLLAPSED TORUS
96
20
94
14
12
14
D

GUY CABLE ALONG EXTENDIBLE ELEMENT
COLLAPSED TORUS

EXTENDIBLE ELEMENT ROLLED ON CORE MEMBER

TORUS ROLLED WITH EXTENDIBLE ELEMENT

TORUS STORED AROUND AND INTO HOLLOW CORE MEMBER

SELF-ERECTING FLOATABLE STRUCTURE

BACKGROUND OF THE INVENTION

There are many uses for floatable structures that include extendible elements such as antennas and the like. Such structures have been used in the past for transmitting a radio signal or the like to indicate the location of the floatable structure or some other related object such as some type of submerged object such as a submarine. Other floatable structures have been utilized to transmit signals to indicate the location of personnel who may be floating in the water in view of the fact that they had to ditch an aircraft. In a similar manner other such floatable structures have been utilized to indicate the location of personnel from a ship that has been sunk.

For instance, U.S. Pat. No. 2,907,875 discloses an emergency radio transmitter for use in broadcasting or indicating the location of forced landings of aircraft on the sea which has a conical shaped tower having a radio antenna which is mounted on a base, and the tower and the base are capable of being inflated by gas from a pressure cartridge or container so that the device can be inflated to make it floatable. Unfortunately, there are several disadvantages related to such a device. For instance, in view of the fact that the antenna is contained within a mast or conical shaped tower, the length of the antenna is of necessity limited. In a similar manner in view of the construction of the mast and the base and the absence of a weight or similar structure, this type of device can be easily tipped over and hence is generally not usable in rough water. Another U.S. Pat. No. 3,068,471 discloses a floating antenna that is adapted for use with receivers or transmitters located aboard small vessels, lifeboats, rafts or the like. This antenna includes an elongated, expandable, watertight casing that contains an antenna wire. A source of compressed gas is also provided that is utilized to fill the casing with compressed gas so that it extends outward lengthwise. The inflated antenna structure then lies on its side in the water so that the antenna wire is generally parallel to the surface of the water. This device has one advantage over the previous device in that practically any length of antenna wire can be utilized whereas that is not the case in the other device. However, with this device the antenna wire is not located in an upright position and for many types of uses this might degrade the ability of the antenna wire to appropriately receive or transmit signals.

Another U.S. Pat. No. 3,312,902 discloses a self-erecting floating structure which does have provision for an upright antenna wire or cord which is located in the interior of an inflatable balloon. However, in view of the fact that the balloon is essentially spherical in shape, there is an inherent practical limitation on the length of the cord or wire that could be utilized. Moreover, in view of the substantially spherical shape of the balloon, it is doubtful whether this structure will maintain its proper upright relationship when floating in rough water. Another U.S. Pat. No. 4,053,896 discloses a self-erecting buoy antenna which may be released from a submerged submarine and the like to float to the surface to provide an erected antenna. In view of the construction of this buoy, the length of its antenna is inherently limited. In addition, it should be noted that this self-erecting buoy structure has no provision for an inflatable buoyant member and hence is not readily storable in a compact configuration. Another U.S. Pat. No. 4,110,724 discloses an extendible antenna apparatus which is released from a submarine or the like. This antenna apparatus has provisions for extending an antenna of substantial length above the level of the water. However, this antenna can be maintained in position only for a comparatively short period of time since its upper portion is only held up by a parachute. As a consequence, transmission or receiving time from such an antenna is of necessity limited.

In view of the foregoing it is apparent that there is a need for a compact, self-erecting floatable structure that has provisions for extending a long antenna or the like and maintaining that long antenna or similar structure in its upright or operational mode even though the floatable structure is located in rough water. The current invention provides such a self-erecting floatable structure that maintains an elongated element in a curled or collapsed configuration and also maintains a buoyant member in a compact configuration prior to activation. Upon activation the elongated element is automatically extended, and the inflatable member is inflated; and in view of the configuration of the inflatable member and the addition of a suitably located weight, the elongated member can be of substantial length and yet be maintained in its upright position in rough water. Moreover, in view of the construction of the self-erecting floatable structure, it is capable of being packaged into an extremely compact structure.

SUMMARY OF THE INVENTION

This invention relates to floatable structures and more particularly to floatable structures which are self-erecting.

Accordingly, it is an object of the present invention to provide a self-erecting floatable structure.

It is an object of the present invention to provide a self-erecting floatable structure which is capable of being utilized in rough water.

It is also an object of the present invention to provide a self-erecting floatable structure which automatically properly orients itself upon its erection in water or the like.

It is also an object of the present invention to provide a self-erecting floatable structure which is usable in receiving and/or transmitting signals.

It is also an object of the present invention to provide a self-erecting floatable structure that is compact when it is in its non-erected configuration.

It is an object of the present invention to provide a self-erecting floatable structure that is readily maintainable in its operational orientation when it is erected.

It is another object of the present invention to provide a self-erecting floatable structure that is activated by contact with a liquid such as water or the like.

It is an object of the present invention to provide a self-erecting floatable structure which is capable of utilizing an elongated, extendible element of comparatively great length.

The foregoing and other objects are obtained by the present invention by providing a self-erecting floatable structure which includes a collapsible extendible element, storage means associated with the collapsible extendible element for storing the element in its collapsed configuration and flotation means operatively connected to the collapsible extendible element for causing the collapsible extendible element and the storage means to float in a liquid such as water or the like.

The storage means provides weight for maintaining the uncollapsed, extendible element in its upright operable orientation; and the shape of the flotation means is such as to also assist in maintaining the uncollapsed extendible element in its upright operable orientation.

BRIEF DESCRIPTION OF THE DRAWINGS

In order that the invention will be more clearly set forth and better understood, reference is made to the accompanying drawings in which.

DETAILED DESCRIPTION OF THE PREFERRED EMBODIMENT

Figure 1:
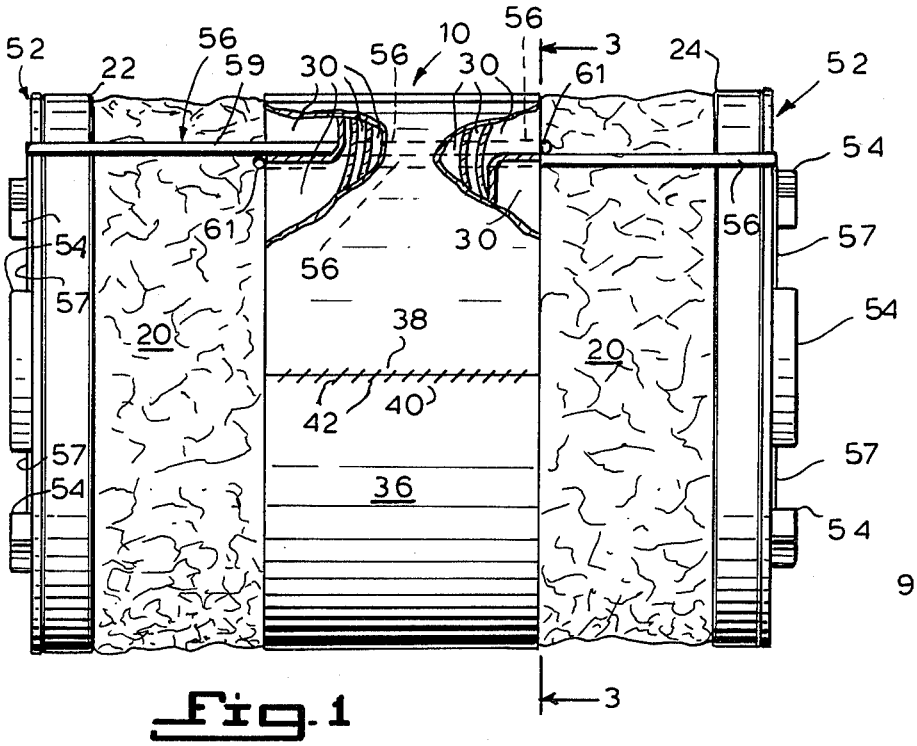
FIG. 1 is a side elevational view of the self-erecting floatable structure of the invention in its non-erected condition.

The self-erecting floatable structure of the present invention is illustrated in its collapsed stored or unerected configuration in FIGS. 1 through 4, and the self-erecting floatable structure is designated generally by the number 10. The self-erecting floatable structure 10 comprises a hollow substantially cylindrical shaped core member 12 which has elongated raised identical space projections 14 located on the outside of the central portion 16 of the hollow core member 12. A ridge 17 is located around the interior 18 of the hollow core member 12. This ridge 17 is centrally located so as to substantially divide the interior 18 in half so that equal portions of the interior 18 are located on each side of the ridge 17. The self-erecting floatable structure also comprises inflatable flotation means comprising an inflatable torus member 20 which is illustrated in its uninflated or collapsed configuration in FIGS. 1 and 4. Inflation means for inflating the inflatable torus member 20 are connected to the torus and comprise two gas generating members 22 and 24. These gas generating members 22 and 24 are ring shaped with a central aperture of sufficient diameter to permit them to be easily slid over the respective end portions 26 and 28 of the core member 12. These gas generating members 22 and 24 are connected to the torus 20 in a manner which will be hereinafter more fully described.

Figure 3:
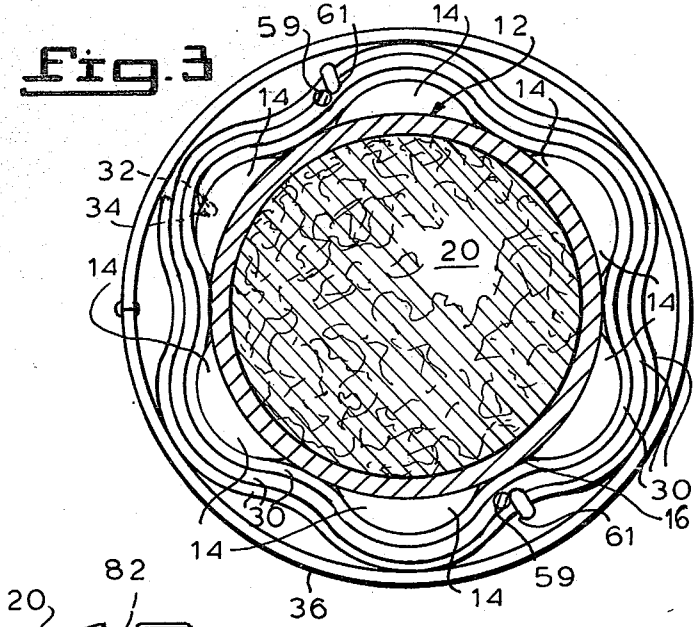
FIG. 3 is a sectional view taken along the line 3—3 of FIG. 1.

The self-erecting floatable structure 10 also comprises a collapsible extendible element 30 which is best illustrated in FIG. 3. As illustrated in FIG. 3 this collapsible extendible element 30 has one end thereof 32 secured to a slot 34 in one of the elongated raised identical space projections 14. The rest of the elongated extendible element 30 is wound around the ridges or lobes 14 on the outer circumference of the core member 12. The entire wound collapsible extendible element 30 is then secured in place by means of the rectangular shaped retainer band 36 whose end portions thereof 38 and 40 are secured by means of a water soluble material such as a water soluble thread or tape 42 which secures the respective edges 38 and 40 of the rectangular shaped retainer band 36.

Figure 4:
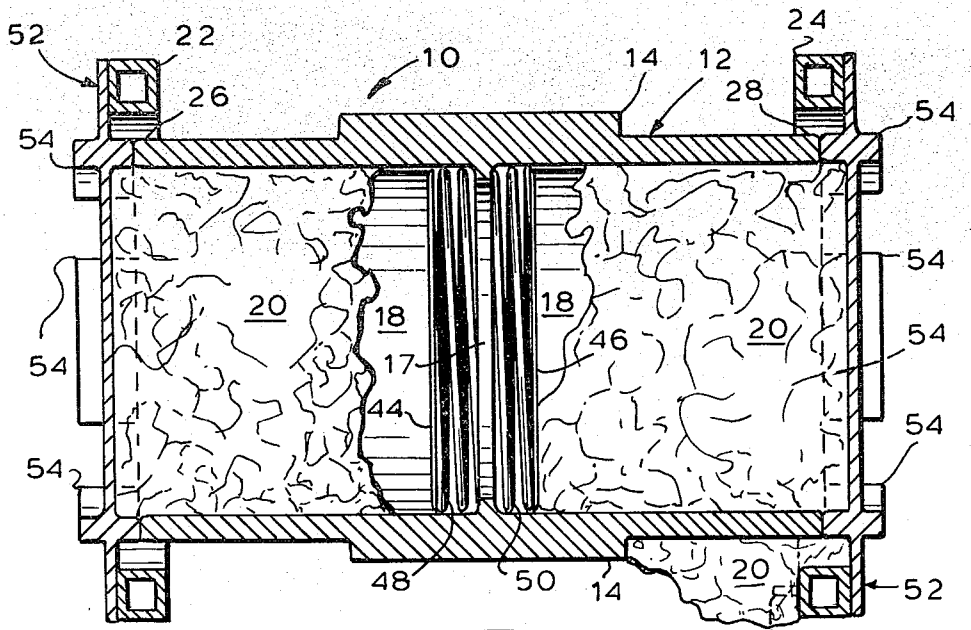
FIG. 4 is a sectional view taken along the line 4—4 of FIG. 2 with certain portions removed for clarity.

As best illustrated in FIGS. 1 and 4 the deflated torus member 20 is stored about the end portions of the core member 12 between the retainer band 36 and the respective gas generating members 22 and 24 which are located in place around the respective end portions 26 and 28 of the core member 12. In addition, as best illustrated in FIG. 4 a portion of the torus member 20 is located in the interior 18 of the hollow core member 12 on each side of the ridge 17. As best illustrated in FIG. 4 the portions of the torus member 20 that are located on each side of the ridge 17 have portions thereof which rest against respective pan shaped members 44 and 46. The lips of these respective pan members 44 and 46 rest against respective springs 48 and 50 whose inner end portions abut against the ridge 17. Consequently, when the portions of the torus 20 that are located in the interior 18 on each side of the ridge 17 are pushed inwardly towards the ridge 17, they exert force against the respective pan shaped members 44 and 46 which causes the respective springs 48 and 50 to be compressed. Consequently, when the self-erecting floatable structure 10 is in its collapsed, stored or un-erected configuration, the springs 48 and 50 exert an outward force against the pans 44 and 46 and hence also the adjacent portions of the torus member 20 which are located in the interior 18 of the hollow core member 12.

Figure 2:
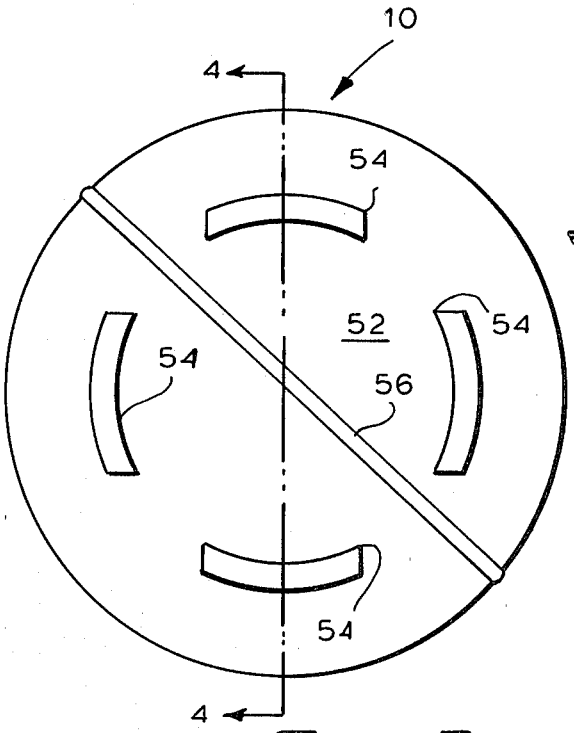
FIG. 2 is an end elevational view of the structure set forth in FIG. 1.
Figures 9A, 9B, 9C, 9D, 9E:
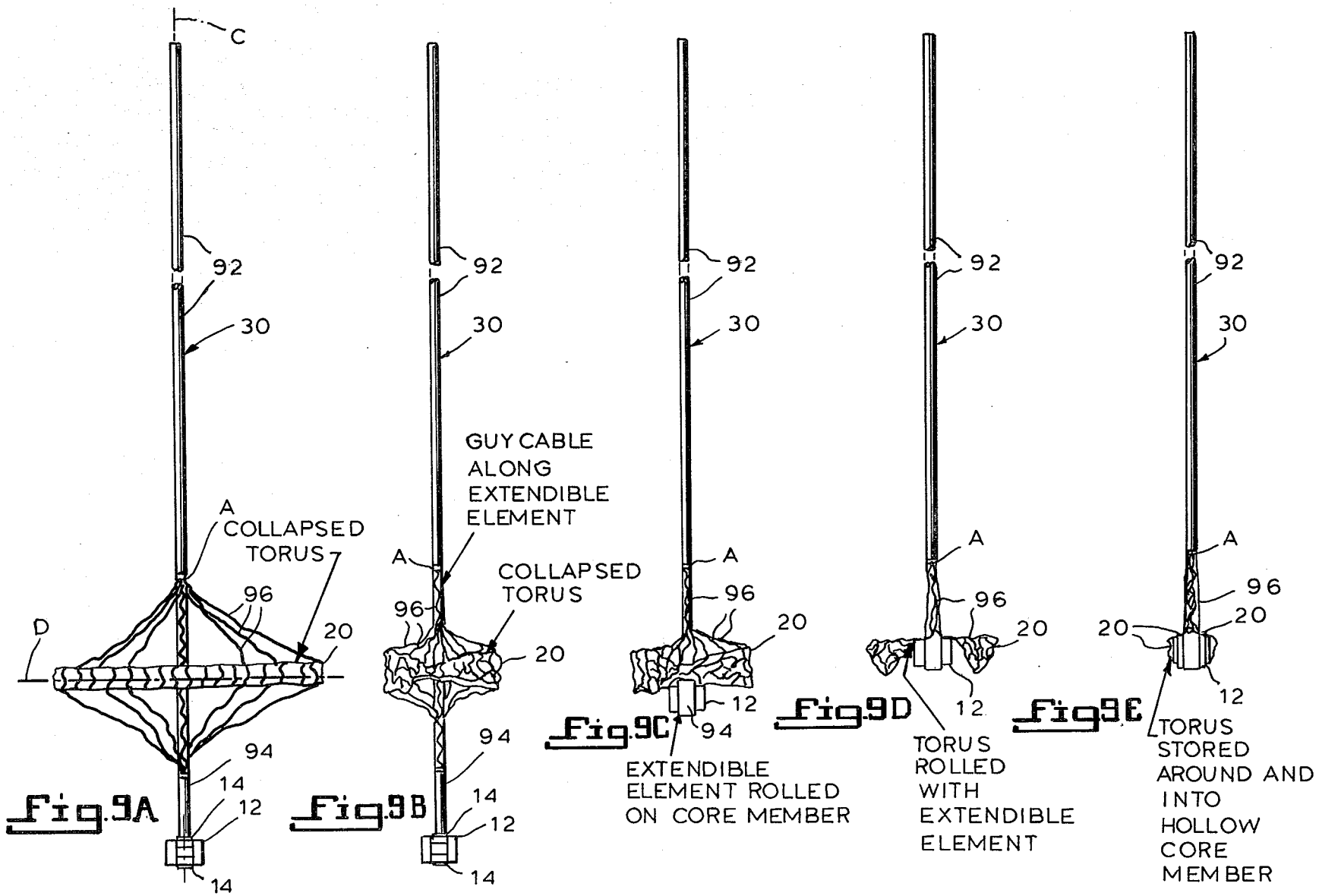
FIGS. 9A, 9B, 9C, 9D and 9E are side elevational views of the structure set forth in FIG. 8 illustrating the respective configuration of the self-erecting floatable structure as it is being packaged when the figures are reviewed sequentially from left to right or deployed as they are viewed from right to left.

In order to retain the portions of the torus 20 located in the interior 18 in place, respective identical retainer members 52 are provided which are adapted to be located adjacent to the end portions 26 and 28 of the core member 12. As best illustrated in FIGS. 1, 2 and 4 each retainer member 52 is generally wafer shaped with integral spaced identical semicircular shaped projections 54 extending from each of its outer surfaces. These projections 54 are sized and located to contact and conform to the respective portions 26 and 28 of the core member 12. In view of the fact that the projections 54 are spaced apart, they permit the passage of a portion of the torus 20 between these projections so that a portion of the torus 20 can be located around the outside of the core 12 and yet be connected to a portion of the torus 20 located in the interior 18 of the hollow core member as best illustrated in FIGS. 4 and 9D.

As best illustrated in FIGS. 1 and 2 the retaining members 52 are secured to place adjacent to the outer end portions 26 and 28 of the core member 12 by a pair of retaining wires or bands 56. These retaining bands 56 are made from a suitable metal or other material such as an appropriate plastic known in the art.

Figure 5:
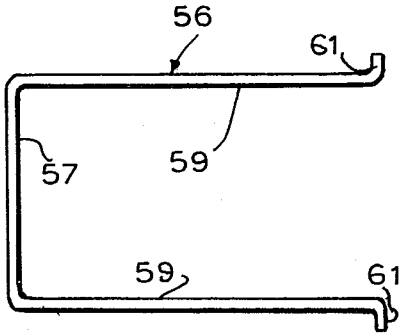
FIG. 5 is a side elevational view of a retaining band which forms part of the structure illustrated in FIGS. 1 and 2.

One of the retaining bands 56 is illustrated in FIG. 5. As illustrated in FIG. 5, the retaining band 56 is generally U-shaped with a substantially straight central portion 57 and two outward extending substantially straight projecting portions 59 which extend outward from the ends of the central portion. These projecting portions 59 are located substantially perpendicular to the central portion 57. Outward extending hook end portions 61 are located at the end of the portions 59 opposite the central portion 57. As illustrated in FIGS. 1 and 2, when the self-erecting floatable structure 10 is packaged in its non-erected configuration after the two retaining members 52 are located in place, a retaining band 56 is placed around one of the retaining members 52 and another retaining band 56 is placed around the other retaining member 52. These retaining bands 56 are located in place so that the central portions 57 contact the outer surface of the respective retaining members 52 and their projecting portions 59 lie along the outside surface of the deflated portion of the torus member 20 which is located adjacent to the retaining members 52. The retaining bands 56 are located so that the outer portion of the projecting portions 59 of one retaining band 56 lie substantially adjacent to the outer portion of the projecting portions 59 of the other retaining band 56.

It will be noted that retaining bands 56 are sized and shaped so that the hook end portions 61 are located in position to engage the edge of the collapsible extendible element 30 which is located opposite from the retaining member 52 which is contacted by the central portion 57 of that retaining band. Consequently, the hook end portions 61 are in position to contact the respective edges of the collapsible extendible element 30 as the element is wound around the ridges or lobes 14. It will be noted that the edges of the element 30 that are contacted by the hook end portions 61 are the edges of the innermost coiled portion of the coiled element 30. Since these hook end portions contact the edges of the innermost coiled portion of the coiled element 30 the retaining bands 56 are held in place as illustrated in FIGS. 1 and 2 as long as the element 30 is coiled about the lobes 14.

When the innermost coiled portions of the coiled element 30 become uncoiled as a result of the release of the coiled element 30 the hook end portions 61 of the respective retaining bands 56 no longer contact the edges of the innermost coiled portion of the element 30. This occurs when the water soluble thread or tape 42 dissolves which releases the retainer band 36 and results in the unrestrained collapsible extendible element 30 exerting an outward force which pushes the retainer band 36 away as the collapsible extendible element 30 is deployed. When the hook end portions 61 of the retaining bands 56 no longer contact the edges of the innermost coiled portion, the force that is exerted outward by the springs 48 and 50 and the respective pan members 44 and 46 against the portions of the torus 20 located in the interior 18 of the core member 12 causes the portions located in the interior 18 of the core member 12 causes the portions located in the interior 18 to be pushed outward and out of the interior 18 of the core member 12. As this occurs, of course, the respective retaining bands 56 and the respective retaining members 52 are pushed outward away from the ends 26 and 28 of the core member 12. As these portions of the torus 20 are pushed outward they also pull with it the portions of the torus 20 that are located on the outside of the core member 12 between the retainer band 36 and the respective gas generating members 22 and 24. In addition, since the gas generating members 22 and 24 are connected to the torus 20 they are also pulled outwardly and away from the end portions 26 and 28 of the core member 12. As a consequence the complete torus 20 is removed from the core member 12.

Figure 7:
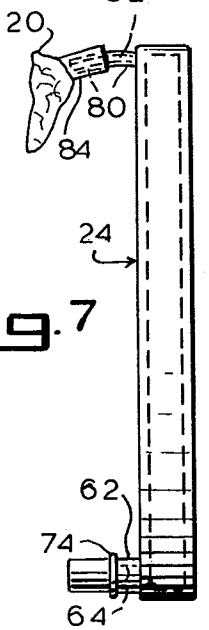
FIG. 7 is a side elevational view of the structure set forth in FIG. 6.
Figure 6:
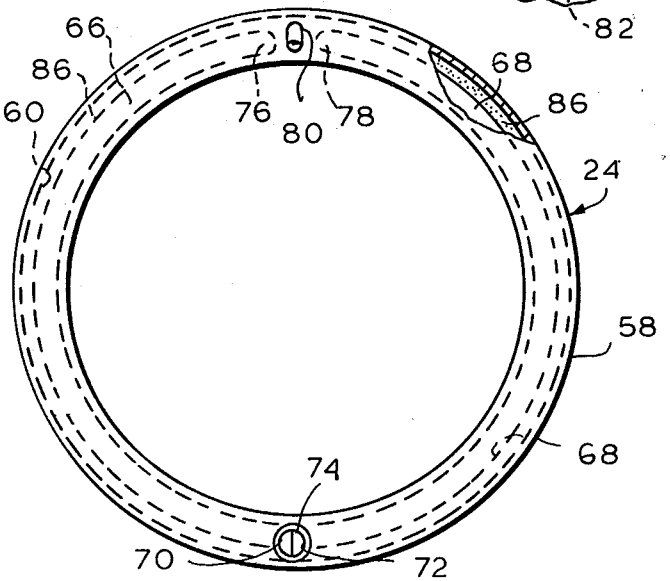
FIG. 6 is a front elevational view of a portion of the structure illustrated in FIG. 1.

The details of the gas generating members 22 and 24 are illustrated in FIGS. 6 and 7 where the gas generating member 24 is illustrated. The gas generating member 24 comprises a circular hollow ring shaped body portion 58 which has a substantially rectangularly shaped cross section. This body portion 58 has an aperture 60 that extends completely around the interior of the body portion 58. A short conduit 62 extends outward from the lower portion of the side of the body portion 58. This conduit 62 has an aperture 64 which is in fluid communication with the aperture 60 located in the body portion 58. Two substantially identical water absorbing wicks 66 and 68 are located within the aperture 60 of the base member and the respective outer ends 70 and 72 of these wicks 66 and 68 project outwardly from the conduit member 62. The outer portions 70 and 72 of the wicks 66 and 68 are retained in position by a locking collar 74.

The inner ends 76 and 78 of the respective wicks 66 and 68 are located within the aperture 60 in the upper portion of the body portion 58 and these ends 76 and 78 are located adjacent to each other. Another conduit 80 extends outward in the upper portion of the body portion 58 and that conduit has an aperture 82 which is in fluid communication with the aperture 60 in the body portion 58. A flexible hollow tubular member 84 is connected to the outer end of the conduit 80 and to a portion of the inflatable torus 20. As illustrated in FIG. 6 powdered or granular calcium carbide, $CaC_2$, 86 is located in the aperture 60 in the body portion adjacent to the wicks 66 and 68. It should also be noted that the outer portions 70 and 72 are shaped so that they fit together to fill the locking collar 74 and the aperture 64.

Although the details with respect to only the gas generating member 24 have been described, it will be appreciated that the details are essentially the same for the gas generating member 22 except that the location of the conduits 62 and 80 is reversed for the gas generating member 22 since the gas generating member 22 is substantially just a mirror image of the gas generating member 24. When the gas generating members 22 and 24 are exposed to water, the outer end portions 70 and 72 of the wicks 66 and 68 absorb water which due to the action of the wicks is pulled into the aperture or conduit 60 within the body portion 58. As the wicks 66 and 68 absorb water, this water also comes into contact with the powdered or granular $CaC_2$ 86 located adjacent to the wicks 66 and 68. The $CaC_2$ 86 will then react with the water to form acetylene gas which is then conveyed from the aperture 60 through the aperture 82 in the conduit 80 through the flexible tube 84 and into the torus 20 to cause inflation of the torus.

Figure 8:
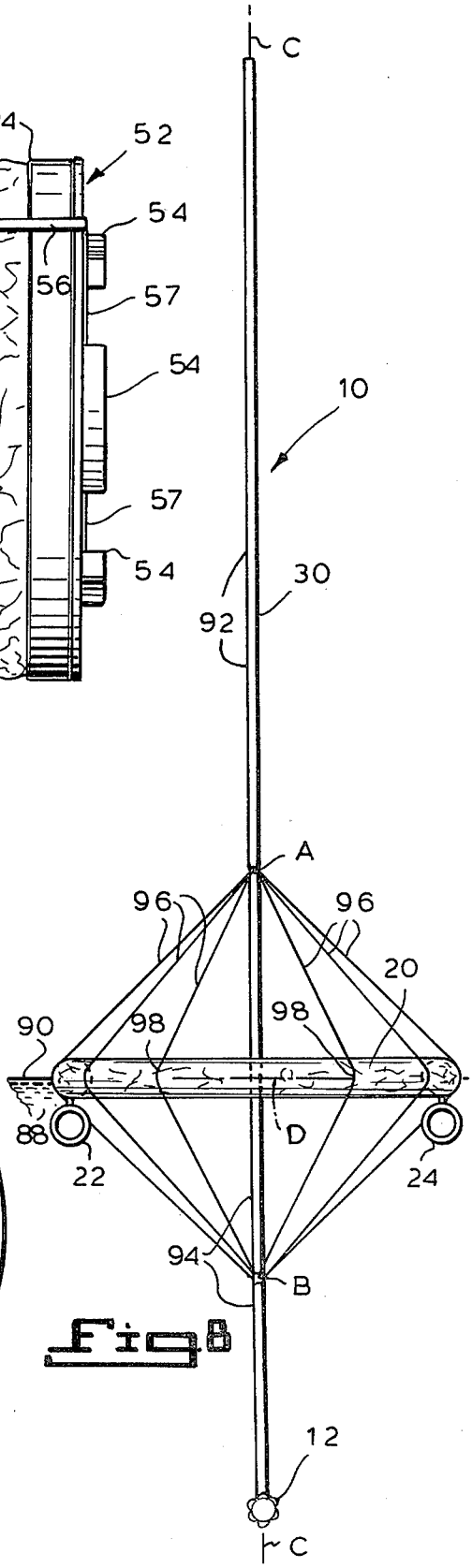
FIG. 8 is a side elevational view of the self-erecting floatable structure illustrated in FIGS. 1 and 2 when the self-erecting floatable structure is fully erected in its operational configuration.

FIG. 8 illustrates the self-erecting floatable structure 10 in its fully erected or deployed configuration in use floating in water 88. It will be noted that the torus member 20 has been inflated so that it lies floating on its side so that a portion of it is above the water level 90. In addition, the collapsible extendible element 30 has been fully extended so that the upper portion thereof 92 projects upwardly above the water level 90 and the lower portion thereof 94 projects downwardly below the water level 90. A series of equally spaced guy wires or cables or other similar elongated members 96 have their upper ends connected to the upper portion 92 of the extendible element 30 at point A and the lower end portions are connected to the lower end portion 94 of the collapsible extendible element 30 at point B. In addition, these guy wires are connected to the outer periphery of the torus at substantially their midpoints 98. In addition, as illustrated these guy wires 96 are substantially equally spaced. In view of the spacing and substantially equal length and the connections of the ends of the guy wires 96 to the extendible element 30, at points A and B, the long axis designated by the letter C of this element is substantially perpendicular to the water level 90 or to the plane designated by the letter D of the inflated torus 20.

In addition, it will be noted that the core member 12 is connected to the lower end of the portion 94 of the collapsible element 30 when the element is in its deployed configuration. As a consequence, since this core member is heavy it tends to act as a weight to maintain the element 30 in an upright condition and to maintain the inflated torus 20 in the water with the plane D of the torus parallel to the water level. Consequently, the inflated torus 20, the associated guy wires 96 connected to the torus and the extendible element 30 in conjunction with the core or weight means 12 all comprise means for maintaining the element 30 in a substantially upright configuration or direction when the self-erecting floatable structure 10 is in its operational configuration. It is important that the gas generating members 22 and 24 be connected to a torus 20 so that they will be on the side of the torus that faces the core member 12 when the self-erecting floatable structure 10 is in its operational erected configuration. This is necessary in order to ensure that the gas generating members 22 and 24 come in contact with the water 88 and hence generate sufficient gas to inflate the torus 20.

FIGS. 9A through 9E illustrate the manner in which the self-erecting floatable structure 10 is sequentially collapsed into its stored, collapsed or unerected configuration. As illustrated in FIG. 9A, it should be noted that the torus 20 is collapsed and that it contains no pressurized gas. As illustrated in FIG. 9A even though the torus 20 is collapsed, it lies in a plane D substantially perpendicular to the long axis C of the collapsible extendible element 30. Then, as illustrated in FIG. 9B, the collapsible torus 20 is pushed inwardly towards the collapsible extendible element 30 and the guy wires 96 are folded along the length of the collapsible extendible element 30 between the points A and B. The next step in packaging the self-erecting floatable structure 10 is illustrated in FIG. 9C where as illustrated the lower end portion 94 of the collapsible extendible element 30 is rolled around the central portion of the hollow core member 12. As illustrated in FIG. 9C, as this portion 94 of the collapsible extendible element 30 is rolled about the exterior of the core member, the guy wires 96 also are being rolled or wound between the coils of the portion 94 that are being wound around the core member 12.

As illustrated in FIG. 9D the next step is to begin rolling the collapsed torus 20 with the collapsible extendible element 30 around the hollow tubular core member 12. The next step as illustrated in FIG. 9E is to store the portions of the collapsible torus 20 within the interior of the hollow core member 12, and at the same time also store portions of the torus curled about the exterior of the core member 12. As illustrated in FIGS. 1 and 4 the two gas generating members 22 and 24 are then slipped partially over the respective ends 26 and 28 of the hollow core member 12. After the gas generating members 22 and 24 have been located in place the retaining members 52 are then located in place adjacent to the ends 26 and 28 of the core member 12 and the retaining bands 56 are then located in place with their central portions 57 around the retaining members 52 and their projecting portions adjacent to each other as illustrated in FIG. 1. The element 30 is then wound further around the lobes 14 so that the edges of the element 30 contact the hook end portions 61 of the retaining bands 56 to secure the retaining bands 56 and the retaining members 52 in place. The next step in packaging the self-erecting floatable structure 10 is to continue rolling the remaining upper portion 92 of the collapsible extendible element 30 including the portions of the guy wires 96 about the hollow core member 12 to obtain the self-erecting floatable structure 10 in the packaged configuration illustrated in FIGS. 1 and 2 and then to secure the collapsed and rolled extendible element 30 in place through use of the retainer band 36 and the water soluble thread or tape as illustrated in FIG. 1. It should be noted that the gas generating members 22 and 24 have been omitted from FIGS. 9A through 9E for clarity.

The previous discussion related to the sequential collapsing of the self-erecting floatable structure 10 associated with FIGS. 9A through 9E also applies to the deployment of the self-erecting floatable structure except that the deployment sequence is the opposite to that set forth in FIGS. 9A through 9E. In other words, deployment initiates with the structure 10 in its configuration set forth in FIG. 1 and sequentially continues with the structure having the configuration illustrated sequentially in the respective FIGS. 9D, 9C, 9B and 9A.

Self-erecting floatable structure 10 is utilized in the following manner. The collapsed or packaged self-erecting floatable structure 10 illustrated in FIGS. 1, 2, 3 and 4 is dropped into the water 88 through some suitable means such as an aircraft or the like. When the packaged self-erecting floatable structure 10 hits the water 88 it may sink for some distance into the water due to its weight. However, as the packaged self-erecting floatable structure 10 sinks in the water, the water acts upon the water soluble thread or tape 42 and causes the thread or tape 42 to dissolve. When the thread or tape 42 dissolves the retainer band 36 is no longer held in place and the retainer band 36 is pushed away by the action of the upper portion 92 of the rolled self-erecting extendible element 30. As the rolled self-erecting extendible element 30 unwinds it reaches a point at the inner end of the outer end portion 92 of the element 30 where the uncoiling portions of the element 30 no longer have their edges in contact with the hook end portions 61 of the retaining bands 56. This results in the release of the retaining bands 56.

When the retaining bands 56 are released portions 20 of the collapsible torus located within the interior 18 of the hollow core member 12 will be pushed outward by the force of the compressed springs 48 and 50 which exert an outward force against the pans 44 and 46 and the adjacent portions of the torus member 20. This causes the retaining members 52 to be pushed outwardly along with portions of the torus 20 and the attached gas generating members 22 and 24. This is sequentially illustrated in FIGS. 9E through 9A with the gas generating members 22 and 24 being omitted for clarity. After the self-erecting floatable structure 10 is substantially in a configuration illustrated in FIG. 9A the gas generating members 22 and 24 are located in the water 88 as illustrated in FIG. 8. As a consequence the outer end portions 70 and 72 of the wicks 66 and 68 of the gas generating members 22 and 24 begin to absorb some of the water 88. As some of the water 88 is absorbed by the wicks 66 and 68 some of this water comes into contact with the powdered or granular $CaC_2$ 86 which results in the generation of acetylene gas within the gas generating members 22 and 24. This acetylene gas is then conveyed to the torus 20 to cause inflation of the torus so that it becomes fully inflated as illustrated in FIG. 8.

As the torus 20 and the extendible element 30 and the connected guy wires 96 are being deployed, it will be noted that the core member 12 which is connected to the lower end of the collapsible extendible element 30 extends downwardly into the water 88 below the level of the torus 20. This core member 12 as previously indicated serves as a weight which tends to keep the self-erecting floatable structure 10 in an upright direction both while it is sinking and when it is floating as best illustrated in FIG. 8. In addition, as previously indicated the inflated torus 20 which rides with its plane D substantially parallel to the water level and the guy wires 96 which are connected to the torus 20 and to the collapsible extendible element 30 also assist in maintaining the extended collapsible extendible element 30 in an upright position. When the self-erecting floatable structure 10 is in its fully erected or deployed condition as illustrated in FIG. 8 it can then be used to transmit, receive or reflect various types of signals. In this connection it will be appreciated that for certain missions additional equipment can be attached to certain portions of the self-erecting floatable structure. This type of equipment might include a receiver or transmitter for sending or receiving radio signals or the like.

Normally it is contemplated when the self-erecting floatable structure 10 is in its fully deployed or erected condition as set forth in FIG. 8 it will not be repackaged and reused. However, should it be desirable to repackage the self-erecting floatable structure this may be accomplished in the manner stated with respect to the original packaging as indicated in the packaging sequence illustrated in FIGS. 9A through 9E. Of course, new gas generating members 22 and 24 will be needed if any of the $CaC_2$ has been utilized.

The type of collapsible extendible element 30 that can be utilized with the invention include the collapsible extendible tubular structure which is set forth in U.S. Pat. No. 3,503,164 and other similar extendible structures that comprise a pair of elongated sheets formed from a preformed material such as beryllium-copper. It should be noted that it is important that the sheets be interconnected along their long edges such as by means of the tabs and slots set forth in U.S. Pat. No. 3,503,164. The hollow core member 12 should be manufactured from a heavy material such as steel, lead, depleted uranium or the like so that it can readily act as an anchor or weight and yet be of a relatively compact or small size.

Although the invention has been described in considerable detail with reference to a certain preferred embodiment, it will be understood that variations or modifications may be made within the spirit and scope of the invention as defined in the appended claims.

What is claimed is:

1. Self-erecting floatable structure comprising a collapsible extendible element, storage means associated with said collapsible extendible element for storing said collapsible extendible element in its collapsed configuration, inflatable means operatively connected to said collapsible extendible element for causing said collapsible extendible element and said storage means to float in a liquid such as water or the like and chemically gas generating means operatively connected to said inflatable means for chemically reacting with the liquid and generating a gas to inflate said inflatable means when in contact with said liquid.

2. The self-erecting floatable structure of claim 1 wherein said collapsible element comprises at least one preformed sheet of material.

3. The self-erecting floatable structure of claim 2 wherein said preformed sheet of material is metallic.

4. The self-erecting floatible structure of claim 1 wherein said storage means also comprises weight means for maintaining said self-erecting floatable structure in an erect orientation when said collapsible extendible element is in its uncollapsed configuration.

5. The self-erecting floatable structure of claim 1 further comprising means for releasing said flotation means from said means for storing said flotation means when said self-erecting floatable structure contacts said liquid.

6. The self-erecting floatable structure of claim 5 wherein said means for releasing said flotation means comprises liquid activated releasing means for releasing said flotation means from said means for storing said flotation means when in contact with said liquid.

7. The self-erecting floatable structure of claim 1 wherein said inflatable means comprises a torus member and connecting means for connecting said torus member to at least a portion of said collapsible extendible element.

8. The self-erecting floatable structure of claim 7 wherein said connecting means comprises a plurality of spaced elongated members connecting the portion of said collapsible extendible element and said torus member.

* * * * *